US005509155A

United States Patent [19]

Zigarac et al.

[11] Patent Number: 5,509,155

[45] Date of Patent: Apr. 23, 1996

[54] ALTERNATING LOW AIR LOSS PRESSURE OVERLAY FOR PATIENT BEDSIDE CHAIR

[75] Inventors: Kevin Zigarac, Plantation; Lydia B. Biggie, Lighthouse Point, both of Fla.

[73] Assignee: Creative Medical, Inc., Ft. Lauderdale, Fla.

[21] Appl. No.: 286,008

[22] Filed: Aug. 4, 1994

[51] Int. Cl.[6] ..... A61G 7/04

[52] U.S. Cl. ..... 5/453; 5/654; 5/455; 297/219.1

[58] Field of Search ..... 5/453, 455, 456, 5/654; 297/219.1, 228.12, 229

[56] References Cited

U.S. PATENT DOCUMENTS

| | | | |
|---|---|---|---|
| 3,297,023 | 1/1967 | Foley | 5/453 |
| 3,390,674 | 7/1968 | Jones | 5/453 X |
| 3,394,415 | 7/1968 | Parker | 5/456 |
| 3,678,520 | 7/1972 | Evans | 5/453 |
| 3,867,732 | 2/1975 | Morrell | 5/453 |
| 5,207,364 | 12/1993 | Volk | 5/453 |
| 5,243,721 | 9/1993 | Teasdale | 5/455 X |
| 5,370,439 | 12/1994 | Lowe et al. | 297/180.13 X |

*Primary Examiner*—Michael F. Trettel

*Attorney, Agent, or Firm*—Haley; DiMaggio & Crosby Malin

[57] ABSTRACT

A pneumatic device for therapeutic treatment of the skin and skin pressure areas of immobile patients seated in a chair, which provides for alternating low air loss pressure sacs that are in contact with the seated patient that includes an air sac array overlay that is conveniently and quickly mounted to a bedside chair, a portable air supply that can be attached for controlling the individual air sac alternating air pressures, the portable air supply housing being mounted on the side arm of a chair, and a separate removable coverlet that is liquid impervious for incontinent patients while providing for sweat absorption for the patient seated thereon. The portable air supply can be quickly detached from the air sac chair overlay for use with a bed mattress air pressure alternating device.

5 Claims, 2 Drawing Sheets

14
20
12
32a
36
38
12a
22
31
24
26
28
16a
43
42
40
46
16
44
35
34
30
12c
12b
10
18
32
18a
18c
18b

ALTERNATING LOW AIR LOSS PRESSURE OVERLAY FOR PATIENT BEDSIDE CHAIR

BACKGROUND OF THE INVENTION

1. Field of the Invention

This invention relates generally to an alternating low air loss pressure chair overlay for an immobile bedside patient to prevent treat skin inflammations and decubitus ulcers while the patient is seated in a bedside chair, and specifically, to an improved alternating air pressure chair overlay, with coverlet, that prevents skin breakdown and allows for single patient, bed and chair dual usage with one air pressure control unit that can be used with an alternating air pressure bed mattress and with the alternating pressure chair overlay.

2. Description of the Prior Art

The use of air mattresses and in particular, alternating pressure air mattresses in beds to prevent decubitus ulcers is well known. U.S. Pat. No. 4,944,060, issued Jul. 31, 1990 to Peery et al., shows a mattress assembly for the prevention and treatment of decubitus ulcers. Typically, a plurality of air sacs or cells are individually filled or emptied at different locations to change the pressure contact on the immobile patient's skin.

Skin diseases, skin pressure problems, and decubitus ulcers are caused from lack of movement when skin areas of a person are subjected to constant pressure for long periods of time. For people who are basically immobile and are bedridden, decubitus ulcers are a serious problem. U.S. Pat. No. 5,267,364, issued Dec. 7, 1993 to Volk, shows a therapeutic mattress that provides a wave-like deformation of the patient-supporting surfaces in tubular elements along a selected portion of the length of a mattress to prevent decubitus ulcers. U.S. Pat. No. 4,953,247, issued Sep. 4, 1990 to Hasty, shows airtight sacs in a parallel array that supports a patient, in which the air pressure can be changed in each individual sac as a function of time. The air sacs are arranged as a support mattress for a patient in bed. The devices shown in the prior art are shown as support bed mattresses for patients who are immobile and confined to bed or bedridden for long periods of time. Oftentimes, it is desirous to have the patient removed from the bed so that the patient can sit upright for periods of time, even though the patient is basically immobile. During periods when the patient is seated in a chair, it would also be desirous to provide a support system that would prevent skin problems continuously caused by skin surface pressure immobility from the support surface. U.S. Pat. No. 4,981,131, issued Jan. 1, 1991 to Hazard, shows a passive motion back support which can be attached to a chair for improving the back support for a person seated.

None of the devices in the prior art provide for an individualized skin pressure sensitive support surface for a patient seated in a chair for long periods of time to prevent decubitus ulcers or other skin diseases. The present invention overcomes these problems, while at the same time providing for a chair-mountable air support device that can utilize a standard air pump and distribution device.

SUMMARY OF THE INVENTION

A pneumatically-adjustable, patient support chair overlay for providing pneumatic support for a seated person, said overlay being connected to a chair for providing variable pressure pneumatic support on the chair seat and on the chair back for alleviating skin disorders of a person seated therein, said overlay comprising a plurality of parallel, independent elongated tubular air sacs mounted together side-by-side, said air sac array being sized in length and width to fit contiguously upon the seat of a chair and upon the inside back of a chair, said overlay including a first end segment flexible sheet (connected to the air sac array but having no air sacs) and a plurality of chair mounting straps connected to selected edges of said air sac array and said flexible sheet, each of said straps being connectable around parts of a chair and the chair legs. The overlay also includes a flexible, protective coverlet having snap fasteners (male and female connectors) to attach to the top of the air sac array. The coverlet is sized to fit over the top of said overlay to provide an impervious liquid barrier to protect against incontinence, but is vapor permeable (breathable) to prevent moisture buildup between the patient skin and the fabric. The coverlet structure includes a moisture absorbent layer to absorb body sweat and moisture. The coverlet structure is comprised of an absorbent fabric sheet attached to a liquid proof nylon sheet and a polyurethane barrier.

The overlay air sacs are filled under pressure by an air pump with pressure and volume control solenoid valves and outlet lines (at least two) and includes a chair arm mount, such as a U-shaped member, to allow the air pump to be hung vertically from one of the chair arms (out of the patient's way). The air pump and control valves and circulating air supply can be used interchangeably between the chair overlay and a mattress system so that the air supply need only be connected to a pair of flexible input air lines which are connected to the air sacs as described below.

In one embodiment, alternating air sacs in a side-by-side array are connected together in fluid communication to a first inlet air supply conduit (manifold) along one side of the length of the chair overlay connected to the output of the air pump. A second inlet air supply conduit is connected in fluid communication to the remaining alternating air sacs not connected to the first air supply conduit. The air pump has two outlet nozzles that connect to the first and second inlet air conduits connected to the air sacs. The solenoid valves direct the air flow from the air pump above atmospheric pressure either into the first conduit or the second conduit based on an electric air supply controller. A timer provided in the air supply control circuitry, which is electrically powered, changes the sequence of the air control valves after a predetermined amount of time passes, such as five minutes. Thus, in the first five-minute time period, the first inlet air supply conduit is supplied with air under pressure that inflates every other air sac to a predetermined pressure level. Adjacent air sacs are not inflated.

In the second five minute period, the alternating other air sacs are filled with air under pressure, while the first filled air sacs lose their air pressure when the pump flow stops and by the force of the seated person's weight.

A patient-engaging strap may also be used once the patient is mounted in the chair for encircling the waist of the patient to aid in or help prevent the patient from sliding downward in the chair.

The purpose of the coverlet is to provide a hygienically clean cover that protects the pneumatic air sac array to allow single patient usage by changing the coverlet and cleaning the coverlet in case the patient is incontinent. This will prevent damage to the pneumatic air sac array. The structure of the coverlet includes a first layer of a nylon material of very minimal thickness attached to a layer of polyurethane approximately 1 mil. in thickness which provides a water and liquid proof barrier. Water vapor will pass through this barrier as backing on the nylon material. An additional layer of an absorbent Dacron quilting material or other suitable vapor absorbent backing is sewn around its edges to the nylon, which is the underside of the coverlet. The Dacron quilting, which is moisture or sweat absorbent, is thus on the underside of the coverlet and abuts the top of the air sac array. The nylon and polyurethane protective barrier is thus on the top side. When a patient sits on the nylon polyurethane barrier, if the patient is incontinent, liquid will not pass through the nylon polyurethane barrier. On the other hand, moisture such as sweat can pass through the nylon polyurethane as vapor, where it is absorbed into the Dacron quilting material so that the patient is comfortable and yet the air sac array is protected, especially from incontinence.

In the operation of the device, the variable air pressure changes to the air sacs per unit time can be set by control circuitry and timer circuitry in an air supply control box that is connected electrically to solenoid-actuated pneumatic valves connected to the air pump conduits. The control box has a U or L-shaped hanger on the box housing top that allows the air supply box to be supported from a chair arm. Each of the air supply first and second air conduits can be quickly attached or detached from the air supply pump in the control box, allowing the portable air supply to be connected to and interchanged with an alternating air pressure bed mattress so that for cost effectiveness, the same air pressure pump and control box can be used with either a pneumatic bed or on a pneumatic chair, depending whether the patient is in the bed or in the chair.

It is an object of this invention to provide a pneumatic overlay for a chair that can provide alternating pneumatic pressure to address problems of skin breakdown and decubitus ulcers for a seated patient.

It is another object of this invention to provide a variable pneumatic pressure patient support overlay that can fit over patient bedside chairs, recliners, stretchers, and geriatric chairs to prevent skin breakdown problems in the patient when seated for long periods of time.

And yet another object of this invention is to provide an improved chair for providing alternating air pressure support overlay to one sitting in the chair, and that also includes a protective cover for hygiene purposes within a hospital environment, with a detachable air supply for use with a pneumatic bed mattress.

In accordance with these and other objects which will become apparent hereinafter, the instant invention will now be described with particular reference to the accompanying drawings.

DESCRIPTION OF THE PREFERRED EMBODIMENT

Figures 1, 1A:
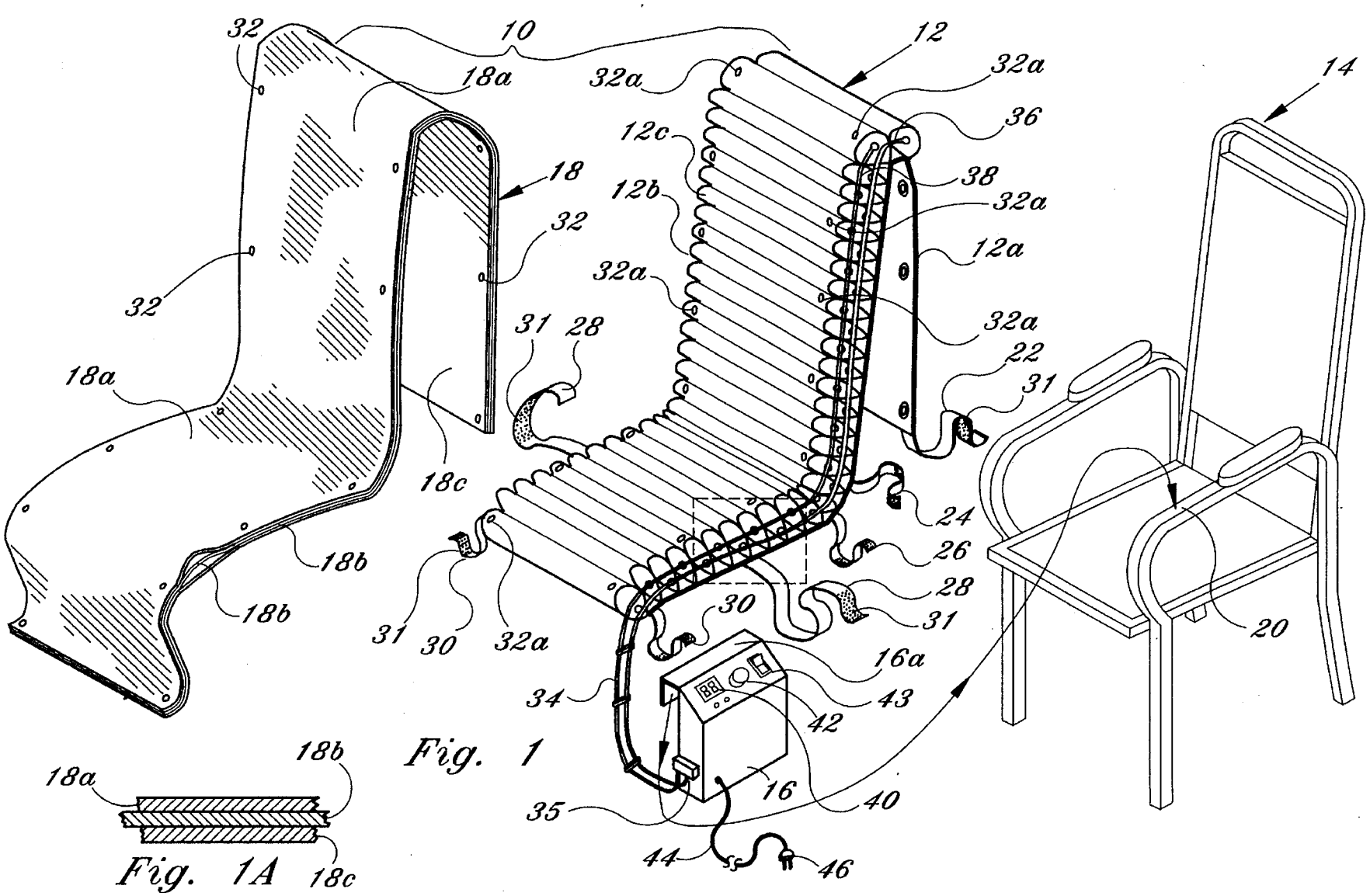
FIG. 1 shows an exploded perspective view of the present invention.
FIG. 1A is a side elevational view in cross section, partially cut away, showing a portion of the coverlet.

Referring now to the drawings, and in particular FIG. 1, the present invention is shown generally as a chair overlay 10, comprised of an alternating air pressure controlled air sac array 12 that can be removably attached to a conventional chair 14 with a plurality of straps, a coverlet 18 that can be removably attached over the top exterior surface of the air sac array 12 as a liquid barrier, a portable air supply including air flow and pressure control for providing air pressure, including a pump housed in air control supply box 16, that includes a hanger 16*a* which allows the entire device to be mounted on the arm 20 of chair 14. The air control components and circuits in supply box 16 are electrically powered, including the air pump maintained therein, through a cord 44 having an outlet plug 46 that plugs into a conventional 110-volt electrical system.

Inside the air control supply box 16 is an electrically powered air pump, an electrical timer that connects to the air pump and to a pair of solenoid valves that are attached to the outlet side of the pump and to inlet conduits 36 and 38, each of which are connected to alternating side-by-side elongated air sacs 12*b* and 12*c* which make up the array. The air supply box 16 includes a controller knob 42 and a power switch 43 which respectively provides for manual pressure adjustment and turning the device on and off.

The air sac array 12 has numerous elongated individual, and individually pressurized, air sacs, pressure controllable through two separate inlet air conduits 36 and 38, which connect alternately to every other air sac for providing individual air pressure into the air sacs. The elongated air sacs are formed from a continuous piece of air impervious material (plastic) that is heat sealed in its construction that forms a side-by-side array of air sacs that are independently sealed and function independently as to the containment of air. The air sacs formed along a single contiguous sheet stretches from a distance equal to the length of the base seat of the chair and the length of the inside back of the chair so that when a person is seated in the chair, their legs, lower torso, and back will press against the air sac array and will be subjected to the alternating air pressure in the air sacs as described below.

The back part of the air sac array 12 includes an end panel or segment 12*a* that is a sheet that stretches down over the back of the chair 14 and terminates in a pair of straps 22 that have hook and pile fasteners 31 connected thereto, which allow the array 12 to be anchored around the legs of the chair 14 to hold the entire air sac array overlay 12 firmly in place on the chair.

Additional straps 24, 26, 28, and 30 are used to firmly attach the air sac array 12 to the base legs of the chair. The straps each contain a fabric fastener such as hook and pile 31, commonly referred to under the trade name Velcro, to allow each of the straps to be secured together tightly to prevent movement of the array 12.

The purpose of the invention is for skin treatment and the prevention of decubitus ulcers, which is provided by alternating areas of force or pressure on the skin of the user. Specifically, an immobile person seated in the chair 14 can be stimulated in different skin areas at different time periods using alternate (spaced apart) air sacs such as 12*c* which are fully pressurized while the adjacent air sacs (on each opposite side) are not pressurized. The unpressurized air sacs collapse under the weight of the person seated in the chair. Periodically and in accordance with a predetermined time period that can be set through the control of the air supply box 16, control knob 42 can be set for the desired pressure of the inflated set of air sacs. At the end of the time period, a different solenoid valve is opened, which allows air under pressure from the air supply box 16 to fully pressurize the alternate air sacs to a predetermined pressure. The previously pressurized air sacs, when not being pressurized, drain air back into their own supply line. By alternating air sacs and the pressure contained therein, different areas of the body will be tactilely stimulated with force pushing against the body area to allow for stimulation of the skin area.

Figure 3:
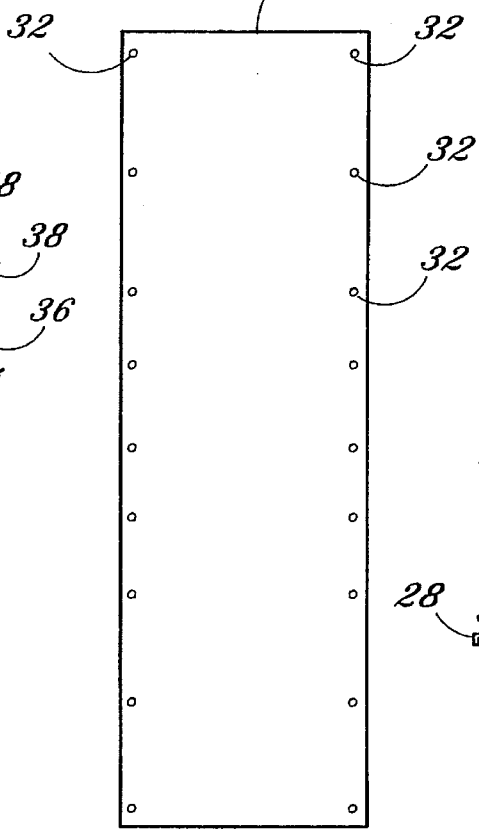
FIG. 3 shows a top plan view of the coverlet used in the present invention.

It is important, especially in a hospital environment, and especially with immobile or geriatric patients, that certain provisions be made for problems such as incontinency or the like. In particular, a coverlet 18, shown in FIG. 1, FIG. 1A, and FIG. 3 is provided that includes snap-fit male and female fasteners 32 that permit the entire coverlet 18 to fit completely over the exterior top of air sac array 12 and can be snapped firmly in place. The coverlet 18 includes an impervious liquid barrier made from a nylon sheet 18*a* and 1 mil. polyurethane sheet 18*b* to prevent liquids from making contact with any surfaces of the air sac array. In addition, coverlet 18 includes a moisture absorbing quilted fabric such as Dacron which may be sewn onto the bottom of the liquid barrier 18*b* so that sweat or moisture can be absorbed in sheet 18*c* to prevent discomfort to the patient while still not permitting liquid from permeating the top layers 18*a* and 18*b* attached to the fabric layer. Moisture vapor will pass through sheet 18*b* but liquid will not.

One important feature of the invention is that the air supply box 16 is portable. The two separate air supply conduits 36 and 38 provide inlet air under pressure for pressurizing the air sacs and can quickly be removed from nozzles 35 mounted on the side of box 16. Detachment allows the air supply box 16 to be transported from the chair 14, where it is hung from chair arm 20, to bedside so that the same air supply source can be used for an alternating air pressure bed mattress that is used on the patient's bed. It is important to note that the same patient would either be in the patient's bed using the alternating mattress or the patient would be bedside sitting in the chair. Since the patient can only be in one or the other place at a time, it is a definite advantage that the air supply 16 can be easily attached or removed from either the alternating air supply chair overlay or the bed mattress, resulting in great cost savings by using only one air supply in both situations.

Each of the air supply conduits 36 and 38 attached along one side of the air sac array 12 supply inlet air to alternating air sacs 12*b* or 12*c* through inlet openings much like a manifold along each side. Thus, conduit 36 supplies air above atmospheric pressure to every other air sac through an opening nozzle that is attached to every other, or alternating, air sacs. Basically, there is one passage into each air sac from the inlet conduit going in at one end through an opening with a steady source of air once the air pressure above atmospheric is introduced into that particular inlet conduit 36 or 38. When the source of air pressure is removed, then residual air in the air sac will travel back into the inlet conduit by seat pressure of the patient, reducing the pressure in the particular air sac.

A separate strap 28 can be used that fits underneath the chair and goes around the midsection of a person Sitting in the chair to hold them firmly in the chair to prevent them from sliding or moving downwardly. The strap 28 also includes Velcro fabric fasteners 31 on each end to allow for maximum adjustability based on the size of the patient seated in the chair.

Figure 2:
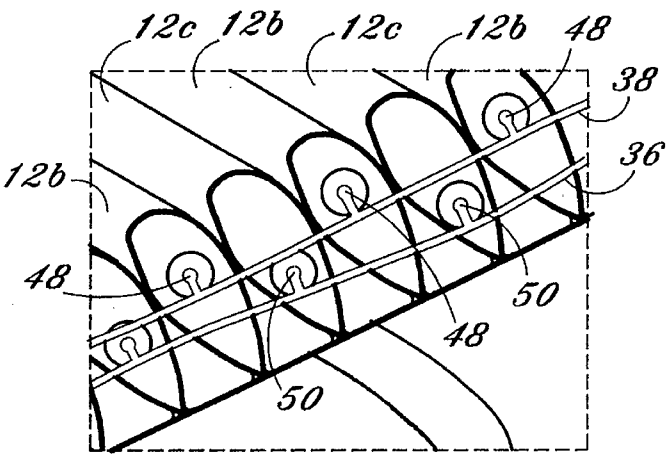
FIG. 2 shows a cut away side elevational view, partially in cross section, of the overlay in accordance with the present invention.

Referring now to FIG. 2, inlet air conduits 38 and 36 are shown, each connected to a different air sac 12*b* or 12*c* for providing alternate air under pressure to alternating air sacs. Air sac 12*b* includes an inlet conduit 48 that allows air in inlet conduit 38 to be received within the air sac 12*b*. To provide alternate air pressure to alternating adjacent air sacs 12*c*, inlet conduit 36 is in fluid communication with inlet conduits 50, which are sealably attached to one end of air sacs 12*c*. Thus, by providing air under pressure into each line individually at different time, such as air pressure into line 36, will result in the inflation under pressure of air sacs 12*c*. Putting air under pressure into inlet air conduit 38 will result in pressure being received in air sac 12*c*. The end of the air sac array conduits 36 and 38 will be sealed as a dead end.

FIG. 3 shows the coverlet 18 that includes a plurality of male and female fasteners 32 such as snaps, which allow portions of the coverlet to be snapped together to prevent its removal from, or slipping on top of, the array 12. Receiving snaps 32 are mounted on array 12.

Figure 4:
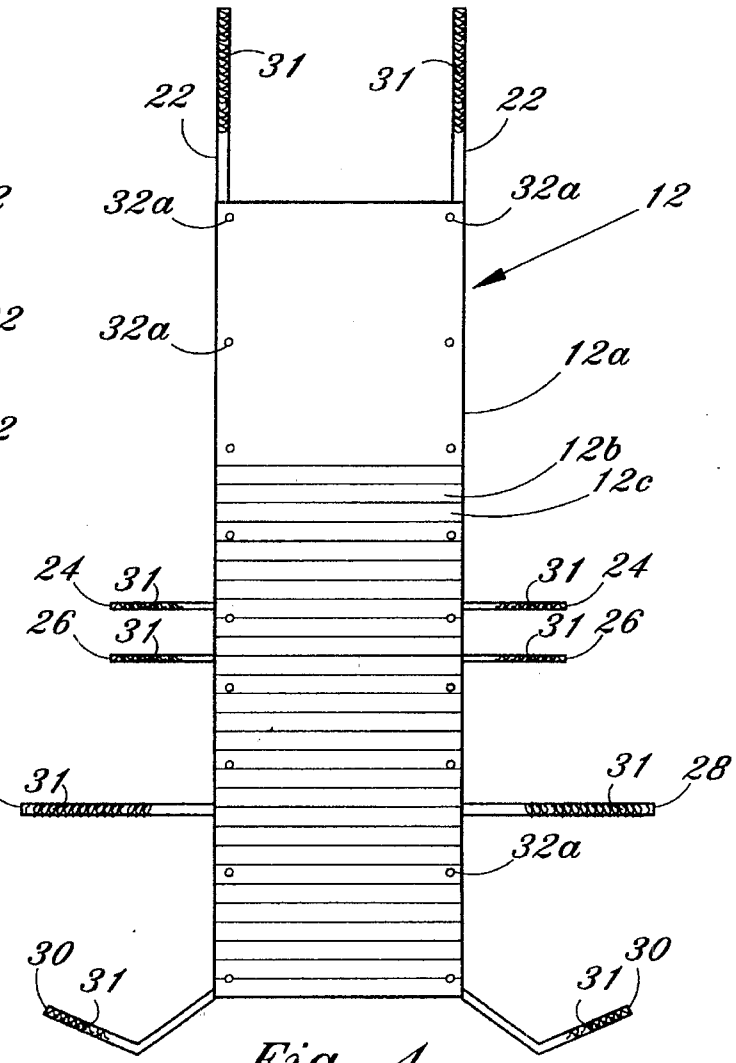
FIG. 4 shows a top plan view of the pneumatic overlay in the present invention.

FIG. 4 shows the series of straps 22, 24, 26, and 30 which attach to the chair legs to prevent slippage of the entire overlay 12.

The overall invention offers several advantages, primarily for preventing or treating skin conditions on immobile patients which may be subject to severe skin conditions because of the immobility, even resulting in decubitus ulcers.

The entire device is extremely convenient and can be easily attached to a bedside chair. With the portable air supply, the air supply can be plugged into any conventional current outlet and mounted conveniently on the chair, where it is out of the way of the patient. The coverlet is put in place which provides for hygienic covering of the device and prevents liquids from being received directly on the air sac overlay.

The power supply and the air supply are portable and can be used in conjunction with either the mattress or the chair, allowing a single controller and air supply to function for two separate environments, which is a great cost savings.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An alternating pressure air sac overlay for therapeutic treatment of an immobile patient's skin while seated in a chair having legs, comprising:

an array of elongated independently sealed air sacs constructed of an airtight material, sized in length to fit across a standard chair, said individual air sacs being tubular in shape, mounted in a fixed side-by-side array, the overall longitudinal length of the air sac array being sized to fit at least on the chair seat of a chair, a first group of independent air sacs being separated by a second group of air sacs in a side-by-side array, so that every other one of said air sacs in said first group and every other alternating one of said air sacs is contiguous with said first group to form said second group of air sacs;

first conduit manifold connected to said first group of air sacs;

second conduit manifold connected to said second group of air sacs;

an air pump having an inlet and an outlet for providing pressurized air in fluid communication and connected to said first conduit manifold and said second conduit manifold;

controllable air inlet valve means connected to said air pump and said first conduit manifold and said second conduit manifold, whereby in a first position, said air inlet valve means provides air pressure only to said first conduit manifold from said air pump, and in a second position, provides air under pressure only to said second conduit manifold from said air pump;

means including timing circuits for controlling air in a timed sequence into said first conduit manifold and said second conduit manifold from said air pump connected to said air pump;

electrical power supply connected to said air pump; and said timing circuits connected to said electrical power supply and said means for controlling air in a timed sequence;

at least two straps, said first strap and said second strap connected to an edge portion of said air sac array overlay for connecting said air sac array overlay to said chair legs for attaching and stabilizing the air sac array overlay to a chair; and a coverlet comprising a liquid impervious barrier means removably connectable to said air sac array, covering said air sac array to provide a protective shield against liquids reaching said air sac array.

2. A device as in claim 1, wherein said coverlet includes at least one liquid impervious yet vapor permeable barrier and a fabric moisture absorption cover for absorbing sweat from someone seated on said coverlet, said air sac array providing low air loss.

3. A device as in claim 1, including a flat sheet connected to said air sac array, including said first and second straps attached thereto for extending down the back side of the chair for mounting and attaching said air sac array firmly to said chair.

4. A device as in claim 1, including a chair having a chair arm wherein said air inlet valve means includes solenoid valves and includes an air supply housing enclosing said air pump and said solenoid valves for controlling the air pressure to the first group of air sacs and the second group of air sacs and to said timing circuits, said air supply housing being sized for individual lifting, said air supply housing including an L-shaped bracket for mounting said air supply housing on a chair arm.

5. A device as in claim 4, including first and second air supply conduit manifold nozzles, sealably, removably attached to said air supply first and second conduit manifolds, said first and second nozzles connected to said air supply housing and in fluid communication with said air pump inside said air supply housing, said first and second air conduit connectors being easily removably attached to said air supply nozzles, which allows the device to be easily attached from the first and second conduit manifolds, so that the air supply housing can be readily detached.

* * * * *